US008408451B2

(12) United States Patent
Adam et al.

(10) Patent No.: US 8,408,451 B2
(45) Date of Patent: Apr. 2, 2013

(54) RECLOSABLE FOLDING BOX WITH TAMPER-EVIDENT CLOSURE WITHOUT ADHESIVE

(75) Inventors: Meino Adam, Heidenheim (DE); Claus Peragowitsch, Steinheim (DE)

(73) Assignee: Carl Edelmann GmbH (DE)

( * ) Notice: Subject to any disclaimer, the term of this patent is extended or adjusted under 35 U.S.C. 154(b) by 212 days.

(21) Appl. No.: 12/728,819

(22) Filed: Mar. 22, 2010

(65) Prior Publication Data

US 2010/0252618 A1 Oct. 7, 2010

(30) Foreign Application Priority Data

Apr. 6, 2009 (EP) ..... 09157409

(51) Int. Cl.
*B65D 5/54* (2006.01)
*B65D 17/28* (2006.01)

(52) U.S. Cl. ..... 229/102; 229/150; 229/222

(58) Field of Classification Search ..... 229/102, 229/148, 149, 222, 150, 155, 223
See application file for complete search history.

(56) References Cited

U.S. PATENT DOCUMENTS

| | | | | | |
|---|---|---|---|---|---|
| 636,806 | A | * | 11/1899 | Johnstone | 229/148 |
| 3,037,684 | A | * | 6/1962 | Andrews et al. | 229/150 |
| 3,403,839 | A | | 10/1968 | Farquhar | |
| 3,462,066 | A | * | 8/1969 | Farquhar | 229/102 |
| 4,063,678 | A | * | 12/1977 | Hall | 229/102 |
| 4,830,270 | A | * | 5/1989 | Holmes | 229/150 |
| 5,207,374 | A | * | 5/1993 | Lo Duca | 229/102 |
| 5,803,345 | A | * | 9/1998 | Jones et al. | 229/102 |
| 5,878,948 | A | * | 3/1999 | Schultz et al. | 229/148 |
| 6,860,421 | B2 | * | 3/2005 | Lo Duca | 229/102 |
| 2006/0124708 | A1 | * | 6/2006 | Lo Duca | 229/102 |

FOREIGN PATENT DOCUMENTS

| | | | | |
|---|---|---|---|---|
| BE | 410524 | A | | 7/1935 |
| DE | 19809466 | A1 | | 3/1998 |
| DE | 10046179 | A1 | | 9/2000 |
| EP | 2003061 | A1 | | 12/2008 |
| GB | 2198708 | A | * | 6/1988 |
| GB | 2251600 | A | * | 7/1992 |

* cited by examiner

*Primary Examiner* — Gary Elkins
(74) *Attorney, Agent, or Firm* — Jansson Munger McKinley & Shape Ltd

(57) ABSTRACT

A reclosable folding box of cardboard with at least one tamper-evident closure is provided, which comprises a lid flap with an insertion tab, a cover tab, and a cutout. The tamper-evident closure of the reclosable folding box can be closed by machine without the need for gluing, and the tamper-evident closure can be opened only by destroying the tamper-evident closure. The insertion tab comprises at least one tear-off tab, to which it is connected along one side by at least one first predetermined break line. The tamper-evident closure is set up in such a way that, when the reclosable folding box is opened for the first time, the insertion tab cooperates in the cutout with the cover tab, so that, when the insertion tab moves beyond a breaking point, the at least one tear-off tab tears at least partially along the at least one first predetermined break line. Alternatively, the cover tab comprises at least one second predetermined break line, and the tamper-evident closure is set up in such a way that, when the reclosable folding box is opened for the first time, the insertion tab cooperates in the cutout with the cover tab, so that, when the insertion tab moves beyond a breaking point, the cover tab is torn at least partially along the at least one second predetermined break line.

13 Claims, 1 Drawing Sheet

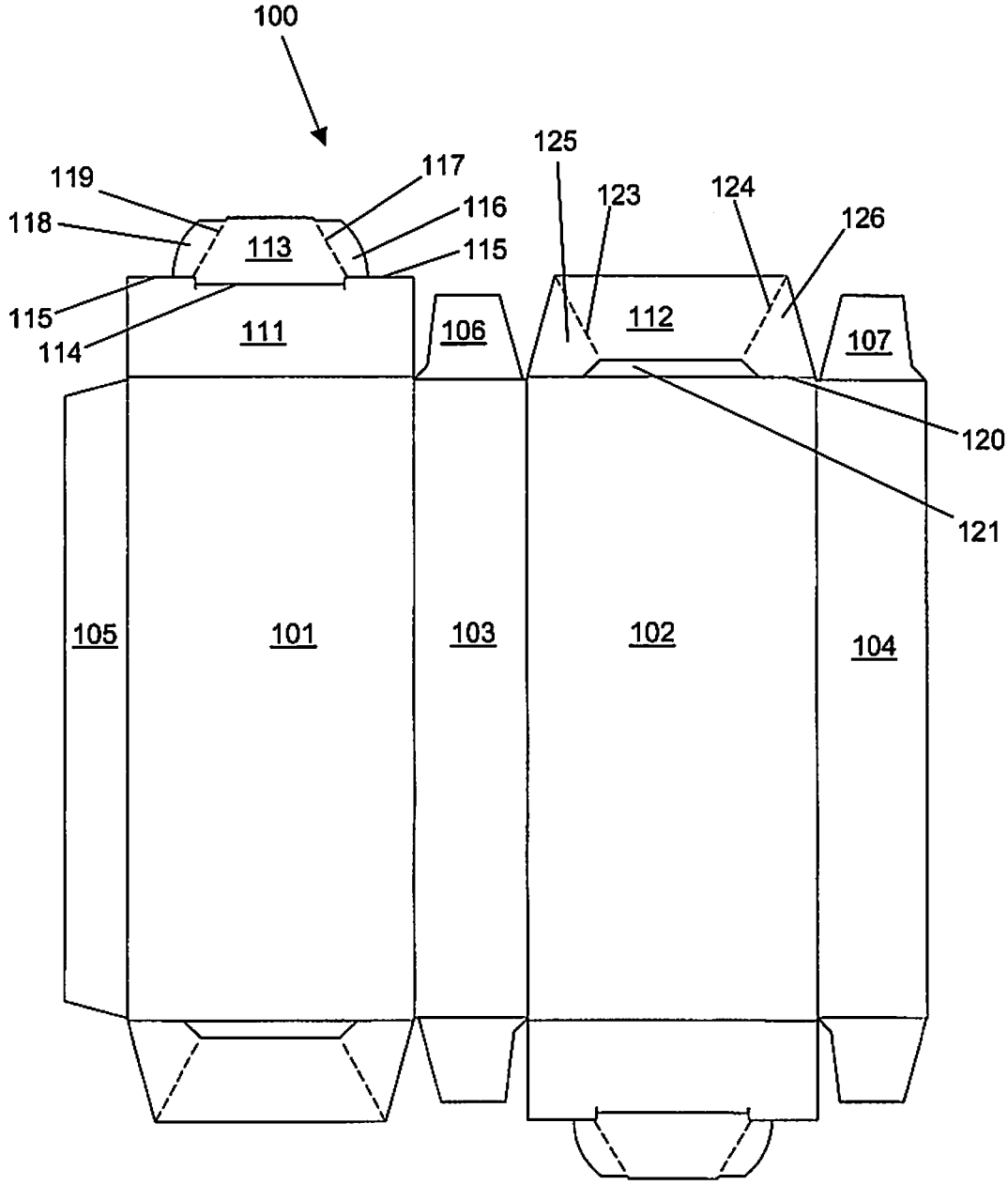
100
119
118
117
116
115
113
115
114
111
106
125
123
124
126
112
107
120
121
105
101
103
102
104

RECLOSABLE FOLDING BOX WITH TAMPER-EVIDENT CLOSURE WITHOUT ADHESIVE

CROSS REFERENCE TO RELATED APPLICATION

This application claims priority based on European patent application EP 09 157 409.5, filed Apr. 6, 2009.

FIELD OF THE INVENTION

The invention pertains to the field of reclosable folding paperboard boxes.

BACKGROUND OF THE INVENTION

According to the prior art, folding boxes are known which comprise a tamper-evident closure, wherein the closure must be glued during the assembly of the folding box. Alternatively, the folding boxes are provided with an (adhesive) label or sealed by polyethylene (PE) sealant. These additionally required steps prolong the assembly process and make it more expensive, because many packaging machines do not have, for example, a gluing device. There is therefore a need for a folding box with a tamper-evident closure without adhesive.

A cardboard pocket with a tamper-evident closure is known from DE 198 09 466 A1. When the cardboard pocket is being closed, a flap hinged to a closure tab is hooked from the outside into a cutout located in the side wall of the cardboard pocket in such a way that, when the pocket is opened for the first time and the closure tab is pulled out, the flap is separated from the closure tab. A cardboard pocket of this type, however, suffers from the disadvantage that the closure is formed externally on the side wall, which means that the surface is not smooth. In the case of mass-produced articles, however, smooth surfaces are important, because there is nothing which some other object can grip or hold on to.

DE 100 46 179 A1 discloses a folding box with tamper-evident closure comprising a tamper-evident tab, which is torn off completely or at least partially along a perforation line when the box is opened. The disadvantage of this folding box is that the temper-evident closure can be bypassed by manipulation. For example, it is possible to reach in and grip the insertion tab from the side and thus prevent the tamper-evident tab from being torn off or partially torn. The tamper-evident closure is therefore not reliable. As a result of the reclosing mechanism formed in the side wall, furthermore, this folding box also suffers from the problem that the side surface is not completely smooth (see above).

EP 2 003 061 A1 discloses another folding box with tamper-evident closure, in which the insertion tab comprises a tear-off tab, which is folded in the direction opposite to the folding direction of the insertion tab and which is torn off when the folding box is opened for the first time. The tear-off tab then engages with retaining means formed in the interior of the folding box. The tamper-evident closure of this folding box suffers from the disadvantage that the retaining means must have a comparatively complicated structure to guarantee that the tear-off tab and the retaining means can engage with each other. It is desirable to overcome these short comings of the prior art.

SUMMARY OF THE INVENTION

An object of the present invention is therefore to provide an improved reclosable folding box with a tamper-evident closure, which can be handled easily and quickly like a conventional folding box during assembly, but does not require any bonding or gluing. A further object is to provide an improved reclosable folding box which offers a reliable tamper-evident closure of simple design.

In a preferred embodiment of the invention, the reclosable folding box of sheet material having an interior with at least one tamper-evident closure, which includes a lid flap with an insertion tab, a cover tab, and a cutout. The tamper-evident closure of the reclosable folding box can be closed by machine without the need for gluing, and the tamper-evident closure can be opened only by destroying the tamper-evident closure, i.e. its original un-tampered state. The insertion tab comprises at least one tear-off tab, to which it is connected along one side by at least one first predetermined break line. Preferably, the tamper-evident closure is set up in such a way that, when the reclosable folding box is opened for the first time, the insertion tab cooperates in the cutout with the cover tab. Accordingly, when the insertion tab moves beyond a breaking point, at least one tear-off tab tears at least partially along the at least one first predetermined break line.

In another preferred embodiment, the reclosable folding box of sheet material has an interior with at least one tamper-evident closure including a lid flap with an insertion tab, a cover tab, and a cutout. The tamper-evident closure of the reclosable folding box can be closed by machine without the need for gluing, and the tamper-evident closure can be opened only by destroying the tamper-evident closure, i.e. its original un-tampered state. The cover tab includes at least one second predetermined break line, and the tamper-evident closure is constructed so that, when the reclosable folding box is opened for the first time, the insertion tab cooperates in the cutout with the cover tab. When the insertion tab moves beyond a breaking point, the cover tab tears at least partially along the at least one second predetermined break line.

In yet another preferred embodiment it is desirable to combine the two folding boxes described above. This has the effect of improving the tamper-evident closure so that the opening of the box will always lead to the partial tearing or complete tearing-off of one component along one of the predetermined break lines. Depending on the selected thickness of the cardboard or on the design of the predetermined break lines, it is possible on a case-by-case basis to control the components which tear first and the amount of force required to tear them.

In the disclosed preferred embodiments, the proper function of the tamper-evident closure is provided in that the opening mechanism cannot be manipulated or averted. In addition, the design is simpler than previously known designs, as after the folding box blank has been punched out and preassembled, it can be set up and filled like a conventional standard folding box. Complicated intermediate steps are thus avoided.

In other preferred embodiments, the folding box includes two first predetermined break lines on the insertion tab which are arranged at an angle of approximately 10° to approximately 90°, and preferably at approximately 60°, to a fold line. This arrangement improves the function of the tamper-evident closure, because the predetermined break lines extend essentially in the opening direction. That is, the orientation of the predetermined break lines makes it easy for the tear-off tabs to be torn off quickly and reliably from the insertion tab.

In another preferred embodiment the cover tab comprises two second predetermined break lines, which are arranged at angle of approximately 10° to approximately 90°, and preferably at approximately 60°, to a fold line. Here, too, the orientation of the predetermined break lines improves the reliability that the cover tab may be torn reliably, either partially or completely, as the opening direction is not essentially perpendicular to the predetermined break line. As noted above, an orientation perpendicular to the break line, which has been used in previous designs, requires greater minimum force to partially or completely tear the tab.

In further preferred embodiments, the insertion tab may have the ability to latch with the remaining components of the cover tab after the folding box has been opened for the first time and after the cover tab has been torn along the at least one second predetermined break line. This improves the reclosability function of the folding box after the tamper-evident closure has been opened.

In additional preferred embodiments, the predetermined break lines are formed in sections by perforation or scoring. In this way, it is also possible to control how easy or how difficult it is to work with the tamper-evident closure. It is therefore possible to change the parameters of the tamper-evident closure to suit a specific set of requirements on a case-by-case basis, depending on the type of material used, the type of box constructed, the use of the box and similar parameters.

In another preferred embodiment the sheet material of the reclosable folding box is a blank of a single piece of material.

BRIEF DESCRIPTION OF THE DRAWINGS

In order that the advantages of the invention will be readily understood, a more detailed description of the invention and the preferred embodiments briefly described above will be rendered by reference to specific embodiments that are illustrated in the appended drawing. Understanding that the drawing depicts only typical embodiments of the invention and is not therefore to be considered to be limiting of its scope, the invention will be described and explained with additional specificity and detail through the use of the accompanying drawing, in which:

FIG. 1 shows the flattened cardboard blank of a folding box according to a preferred embodiment of the present invention.

DETAILED DESCRIPTION OF THE INVENTION

FIG. 1 shows the flattened cardboard blank 100 of a folding box according to the invention. Blank 100 consists of two wide main panels 101, 102 and two narrow main panels 103, 104. A glue tab 105 adjoins the one wide main panel 101. Alternatively, glue tab 105 can be positioned or arranged on an alternate main panel. A closure tab 106, 107 is attached to each end of the two narrow main panels 103, 104. A lid flap 111 is attached to the wide main panel 101, and a cover tab 112 is attached to the wide main panel 102, so that they are opposite each other when the box is assembled. Because the folding box blank for a folding box shown in FIG. 1 has two identical closures, which are arranged with point symmetry on opposite longitudinal sides of blank 100, the present invention is explained only on the basis of the description of one closure. Accordingly, the description of the second closure in FIG. 1 and the indication of reference numbers such a second closure are omitted. The arrangement of the closures can also be axially symmetric, so that, in the final state, both closures can be opened from the same side.

An insertion tab 113 is hinged to lid flap 111 along a fold line 114, which is parallel to edges 115. Edges 115 lie on the same line. Fold line 114 are offset from the edges 115 so that, in the closed state of the folding box, insertion tab 113 lies essentially on the inside surface of the main panel 102. Such construction provides a good fit and the desired tamper-evident closure. In the preferred embodiment shown in FIG. 1, insertion tab 113 includes two predetermined break lines 117, 119, which are symmetrical to each other and form an angle of approximately 60° to the fold line 114. These break lines form two tear-off tabs 116, 118 on insertion tab 113. One end of each line begins at a point near the transition between edge 115 and fold line 114. It should be noted that the tear-off tabs 116, 118 are not connected directly to the edges 115.

The predetermined break lines 117, 119 are preferably designed as perforated lines. Alternatively, only a single predetermined break line, which begins at one of the two above-mentioned transitions, can be present. Predetermined break lines 117, 119 are preferably designed so that the act of folding the tear-off tabs 116, 118, for example, has the effect of tearing them off.

In the preferred embodiment of FIG. 1, the cover tab 112 is trapezoidal in shape and is hinged to wide main panel 102 by way of a fold line 120. In the middle of fold line 120, a cutout 121 is arranged, the width of which is essentially the same as the width of the insertion tab 113 plus the two tear-off tabs 116, 118. The height of cutout 121 is small in comparison to its width. In the preferred embodiment shown here, cutout 121 comprises the form of a trapezoid. Two predetermined break lines 123, 124 proceed outward from the endpoints of the shorter of the two long sides of the trapezoidal cutout 121, forming an angle of about 60° to the fold line 120, and terminate at the corners of the trapezoidal cover tab 112.

It should be noted that the predetermined break lines 123, 124 could also be arranged at other angles including angles of about 10° to about 90° to fold line 120. To ensure the proper function of the inventive folding box, it is important that the angle be as obtuse as possible, so that the direction of predetermined break lines 123, 124 extends in the direction of movement of the insertion tab 113 when the folding box 100 is opened for the first time. The cover tab 112 and the cutout 121 could also have shapes other than that of a trapezoid.

In the following detail description, the function of the inventive folding box with tamper-evident closure is described on the basis of the preferred exemplary embodiment shown in FIG. 1. The sequence of steps is not to be considered limiting to the invention.

The folding box blank shown in FIG. 1 is produced from suitable material, including paperboard, cardboard or the like, punched out as appropriate, and provided with the appropriate folding lines, scoring lines and predetermined break lines. In a first step, a sufficient amount of glue is applied to the outside surface of glue tab 105. Then glue tab 105 is glued to narrow main panel 104. The result of the preliminary gluing process performed thus far is a so-called "pre-glued" folding box, which is flattened out and delivered in this form by the packaging manufacturer (delivery condition). Thus the inventive folding box involves a minimum number of steps to reach a delivery condition.

These types of pre-glued folding boxes are then filled with the desired merchandise by means of known packaging machines. Before they are filled, the flat, pre-glued folding box is set upright, and side tabs 106, 107 at one end of folding box 100 are first folded over by 90°. Then cover tab 112 is folded over by the same amount. To close the folding box, both lid flap 111 and insertion tab 113 are folded along the associated fold lines, and insertion tab 113 is introduced into the cutout 121 until the transition areas of insertion tab 113 and tear-off tabs 116, 118 engage with the acutely angled sections of cutout 121.

After the box has been filled, the inventive folding box with tamper-evident closure is ready to be closed at the other end as described above.

After the tamper-evident closures have been closed, the folding box with its content is in the "original packaging" state. When the folding box is to be opened, as in the case of a conventional folding box, the user extends a thumbnail for example, into cutout 121, i.e., between main panel 102 and insertion tab 113. The user then pushes insertion tab 113 and lid flap 111 and thus the entire tamper-evident closure outward, i.e., in the opening direction. Subsequently, tear-off tabs 116, 118 resting against the edges of cutout 121 move outward in the opening direction. As a result, a force is exerted on tear-off tabs 116, 118 and on cover tab 112, and when the breaking point is exceeded, at least one of the predetermined break lines starts to tear. This tearing, which marks the change of status of the tamper-evident closure, is clearly recognizable to the user. Depending on the design of predetermined break lines 117, 119, 123, 124, it is possible in the embodiment shown here for all or only some of these predetermined break lines to tear, either partially or completely.

In each case the inventive folding box can be reclosed since, even if predetermined break lines 123, 124 have been torn completely, components 125, 126 of the cover tab 112 remain connected to main panel 102. Hence, insertion tab 113 can be positioned and latched in place with or without the tear-off tabs 116, 118.

Reference throughout this specification to "one embodiment," "an embodiment," "a preferred embodiment" or similar language means that a particular feature, structure, or characteristic described in connection with the embodiment is included in at least one embodiment of the present invention. Thus, appearances of the phrases "in one embodiment," "in an embodiment," "in a preferred embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

While the present invention and its principles have been shown and described in connection with certain exemplary or specific embodiments, it is to be understood that the invention is not limited to the disclosed embodiments, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

What is claimed is:

1. A reclosable folding box of sheet material having an interior with at least one tamper-evident closure comprising a lid flap with an insertion tab, a cover tab hinged to a wide main panel by way of a fold line, and a cutout arranged along the fold line, wherein the tamper-evident closure of the reclosable folding box can be closed by machine without the need for gluing, and wherein the tamper-evident closure can be opened only by destroying the tamper-evident closure, the insertion tab comprising at least one tear-off tab, to which it is connected along one side by at least one predetermined break line; and the closure being designed in such a way that, when the reclosable folding box is opened for the first time, the insertion tab cooperates in the cutout with the cover tab so that, when the insertion tab moves past a breaking point, the at least one tear-off tab is torn at least partially along the at least one predetermined break line.

2. The reclosable folding box of claim 1 further comprising two predetermined break lines which are arranged at an angle of approximately 30° to approximately 90°, preferably of 60°, to the fold line.

3. The reclosable folding box of claim 2 wherein the predetermined break lines are formed in sections by perforation or scoring.

4. The reclosable folding box of claim 1 wherein the sheet material of the folding box is a blank of a single piece of material.

5. The reclosable folding box of claim 1 further comprising two predetermined break lines, the two predetermined break lines arranged at an angle of approximately 60° to the fold line.

6. A reclosable folding box of cardboard with at least one tamper-evident closure comprising a lid flap with an insertion tab, a cover tab hinged to a wide main panel by way of a fold line, and a cutout arranged along the fold line, wherein the closure of the folding box can be closed by machine without the need for gluing, and wherein the closure can be opened only by destroying its original un-tampered state, the cover tab comprising at least one predetermined break line; and the closure being designed in such a way that, when the box is opened for the first time, the insertion tab cooperates in the cutout with the cover tab so that, when the insertion tab moves past a breaking point, the cover tab is torn at least partially along the at least one predetermined break line.

7. The reclosable folding box of claim 6 further comprising two second predetermined break lines, which are arranged at an angle of 30-90°, preferably of 60°, to the fold line.

8. The reclosable folding box of to claim 6 wherein, after the folding box has been opened for the first time and after the cover tab has been torn along the at least one predetermined break line, the insertion tab is held latched in place by the remaining components of the cover tab.

9. The reclosable folding box of claim 7 wherein the predetermined break lines are formed in sections by perforation or scoring.

10. The reclosable folding box of to claim 7 wherein after the folding box has been opened for the first time and after the cover tab has been torn along the at least one second predetermined break line, the insertion tab is held latched in place by the remaining components of the cover tab.

11. The reclosable folding box of claim 8 wherein the at least one predetermined break line is formed in sections by perforation or scoring.

12. The reclosable folding box of claim 6 wherein the sheet material of the folding box is a blank of a single piece of material.

13. The reclosable folding box of claim 6 further comprising two predetermined break lines, the two predetermined break lines arranged at an angle of approximately 60° to the fold line.

* * * * *